US006392136B2

(12) United States Patent
Kondo et al.

(10) Patent No.: US 6,392,136 B2
(45) Date of Patent: May 21, 2002

(54) MUSICAL TONE GENERATION STRUCTURE OF ELECTRONIC MUSICAL INSTRUMENT

(75) Inventors: Masao Kondo; Hiromi Hikida; Kei Kunisada, all of Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 09/884,281

(22) Filed: Jun. 19, 2001

(30) Foreign Application Priority Data

Jun. 19, 2000 (JP) ..... 2000-182473

(51) Int. Cl.[7] ..... G10H 1/32; G10H 3/18
(52) U.S. Cl. ..... 84/718; 84/743; 84/DIG. 1
(58) Field of Search ..... 84/644, 670, 718–721, 84/743–746, DIG. 1

(56) References Cited

U.S. PATENT DOCUMENTS 5,248,846 A 9/1993 Koike et al.
5,335,283 A 8/1994 Torii

*Primary Examiner*—Stanley J. Witkowski

(74) *Attorney, Agent, or Firm*—Morrison & Foerster LLP

(57) ABSTRACT

An electronic musical instrument such as an electronic piano has a musical tone generation structure that closely simulates and reproduces musical tones with nuances of musical expressions with fidelity to acoustic musical instruments such as acoustic pianos. In the casing of the electronic piano, speakers are attached to a speaker attachment plate, which is placed substantially horizontal, such that front sides of the speakers are directed upwards. The sounds radiated from the front sides of the speakers are reflected by a reflector board which is hinged to close or open at a prescribed angle of inclination with respect to a top board, so that reflected sounds are transmitted towards the audience. Enclosures are provided inside of the casing below the speaker attachment plate and contain mufflers having a relatively small thickness therein. Through holes whose openings are directed downwards are formed to penetrate through a bottom plate of the enclosures, wherein the total area of openings of the through holes is larger than the total area of the speakers. Sounds radiated from the backsides of the speakers propagate through the enclosures and are transmitted towards the floor via the through holes, so that reflected sounds are transmitted towards the audience through the air. Further, the electronic piano as a whole vibrates in response to vibrations caused by the speakers. Thus, the electronic piano produces mixed sounds that reproduce acoustic musical tones having the nuances of musical expression of an acoustic piano.

14 Claims, 6 Drawing Sheets

MUSICAL TONE GENERATION STRUCTURE OF ELECTRONIC MUSICAL INSTRUMENT

BACKGROUND OF THE INVENTION

1. Field of the Invention

This invention relates to musical tone generation structures that are applicable to electronic musical instruments, particularly electronic pianos.

2. Description of the Related Art

In general, electronic pianos incorporate amplifiers and speaker systems for producing musical tones corresponding to musical tone signals being reproduced. It is an important problem for the electronic pianos to produce musical tones, which closely simulate actual piano sounds being actually produced by acoustic pianos. For this reason, engineers make every efforts to improve sound simulation techniques, particularly techniques of sound sources. In practice, it is very difficult to perfectly reproduce subtle nuances in the musical expression of acoustic pianos.

Through studies and experiments, we have reached a conclusion that the unique nuances in musical expression (or sound generation) of acoustic pianos are due to their tone-generation mechanisms. In acoustic pianos, hammers strike the strings to cause vibrations, which are transmitted to the soundboards via bridges. Thus, the soundboards vibrate to generate musical tones. Due to vibration of the soundboards, acoustic pianos (e.g., grand pianos) vibrate as a whole. Herein, musical tones are produced from both of an upper portion and a lower portion of the piano. The musical tones that are radiated from the upper portion of the piano are reflected by the top board (or reflector board), while the musical tones that are radiated from the lower portion of the piano are reflected by the floor. Then, the reflected musical tones are transmitted towards the audience by the air. It seems that the aforementioned operations play an important role in the formation of the nuances of the musical expression of acoustic pianos.

SUMMARY OF THE INVENTION

It is an object of the invention to provide a musical tone generation structure of an electronic musical instrument that is designed to closely reproduce the nuances of musical expression of an acoustic piano and the like.

In a first aspect of the invention, speakers are attached to a speaker attachment plate, which is installed inside of the casing and is arranged substantially horizontal in the normal use state of the electronic musical instrument, such that the front sides of the speakers are directed upwards. Sound release holes (or through holes) whose total area is larger than the total area of the speakers are formed to penetrate the bottom plate, which is arranged below the speaker attachment plate within the casing. In addition, enclosures are formed to enclose backsides (or rear sides) of the speakers attached to the speaker attachment plate.

In a second aspect of the invention, the enclosures are defined by the bottom plate and a side board that has a nonlinear circular arc shape in plan view. That is, two enclosures having different shapes in plan view are respectively formed in a left-side area and a right-side area within the casing below the speaker attachment plate. Thus, sounds radiated from the backsides of the speakers propagate downwardly through the enclosures and are further transmitted downwardly via the sound release holes toward the floor, on which the electronic piano is placed. Further, a reflector board whose one side can be lifted up and down is arranged above the speakers attached to the speaker attachment plate, and it is opened at a certain angle of inclination with respect to the horizontal plane corresponding to the top board of the electronic piano. Thus, the sounds radiated from the front sides of the speakers are reflected by the reflector board, similarly to acoustic pianos.

Further, the casing of the electronic piano as a whole vibrates in response to the vibrations emitted by the speakers that are driven in response to player's performance on the keyboard of the electronic piano.

Thus, the electronic piano is capable of producing mixed sounds that contain first reflected sounds which are radiated from the front sides of the speakers and are reflected by the reflector board and second reflected sounds which are radiated from the backsides of the speakers, transmitted through the enclosures, and then reflected by the floor as well as additional sounds which are caused by the casing of the electronic piano due to the vibrations of the speakers.

BRIEF DESCRIPTION OF THE DRAWINGS

These and other objects, aspects and embodiments of the present invention will be described in more detail with reference to the following drawing figures, of which.

DESCRIPTION OF THE PREFERRED EMBODIMENT

This invention will be described in further detail by way of examples with reference to the accompanying drawings.

Figure 1:
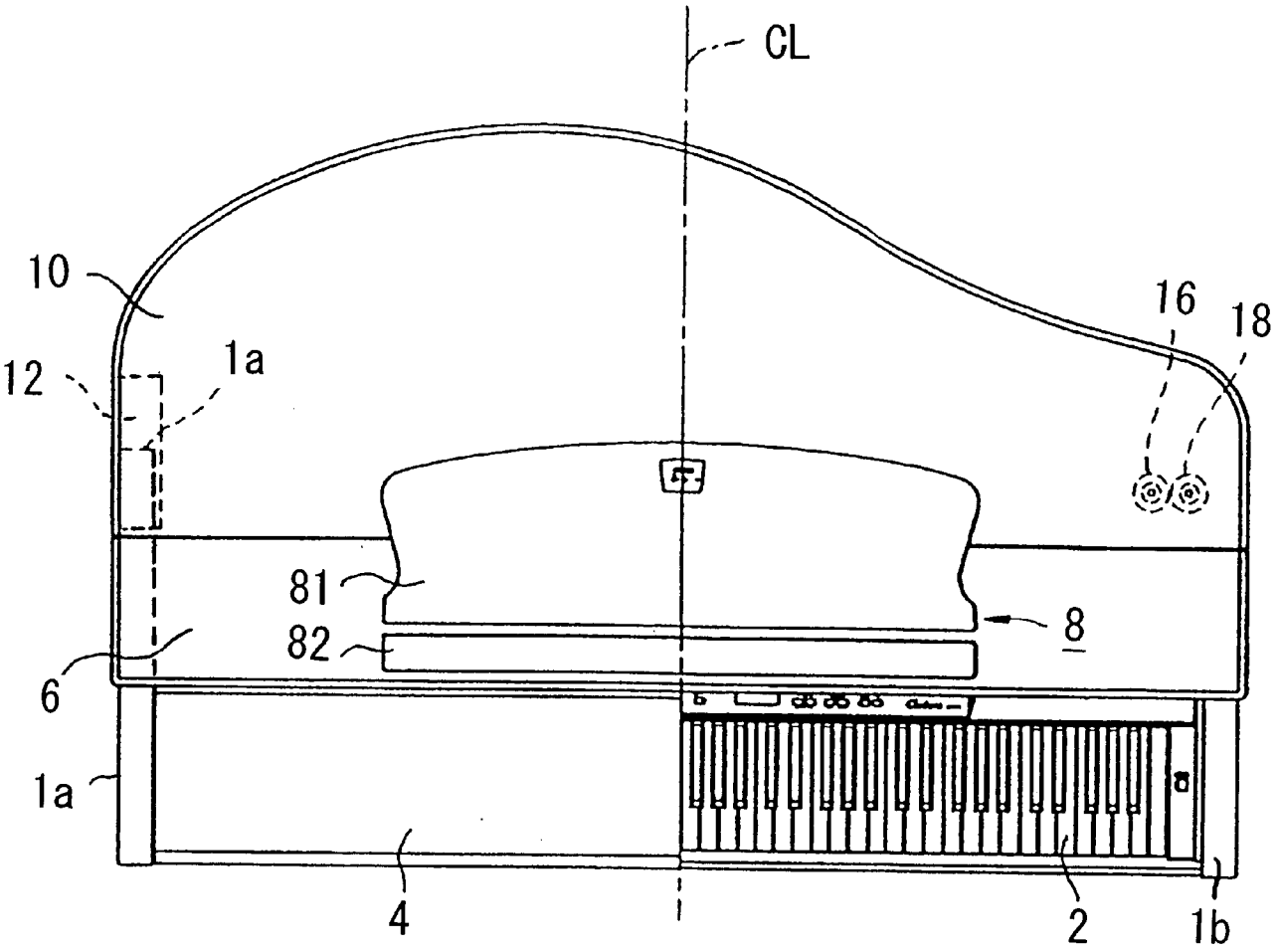
FIG. 1 is a plan view showing the appearance of an electronic piano in accordance with a preferred embodiment of the invention.

In FIG. 1, reference numeral 2 designates a keyboard that is arranged at the front side of an electronic piano. Reference numeral 4 designates a fall cover that covers the keyboard 2 and that can be freely moved to open or close. FIG. 1 shows a center line CL over which the manner of illustrating the electronic piano changes. That is, the right side of the center line CL shows an illustration in which the fall cover 4 has been removed from the keyboard 2, while the left side of the center line CL shows an illustration in which the fall cover 4 is closed to cover the keyboard 2. Reference numeral 6 designates a top board of a casing, which is arranged at the rear side in the plan view with respect to the keyboard 2. Reference numeral 8 designates a music stand that includes a score board 81 and a score rest 82. The music stand 8 is arranged on the upper surface of the top board 6 of the casing of the electronic piano. Reference numeral 10 designates a reflector board that covers the upper surface area of the electronic piano except for the area covered by the top board 6. Reference numeral 12 designates a hinge that is fixed to the left end portion of the casing of the electronic piano, specifically at the upper end surface of the left arm 1*a* made of a wood material. The hinge 12 supports the left end of the reflector board 10 such that the right portion of the reflector board 10 can pivotally rotate about the hinge 12. Reference numeral 1*b* designates a right arm made of a wood material. Stay receptors 16, 18 are fixed at prescribed positions of the backside of the reflector board 10.

Figure 2:
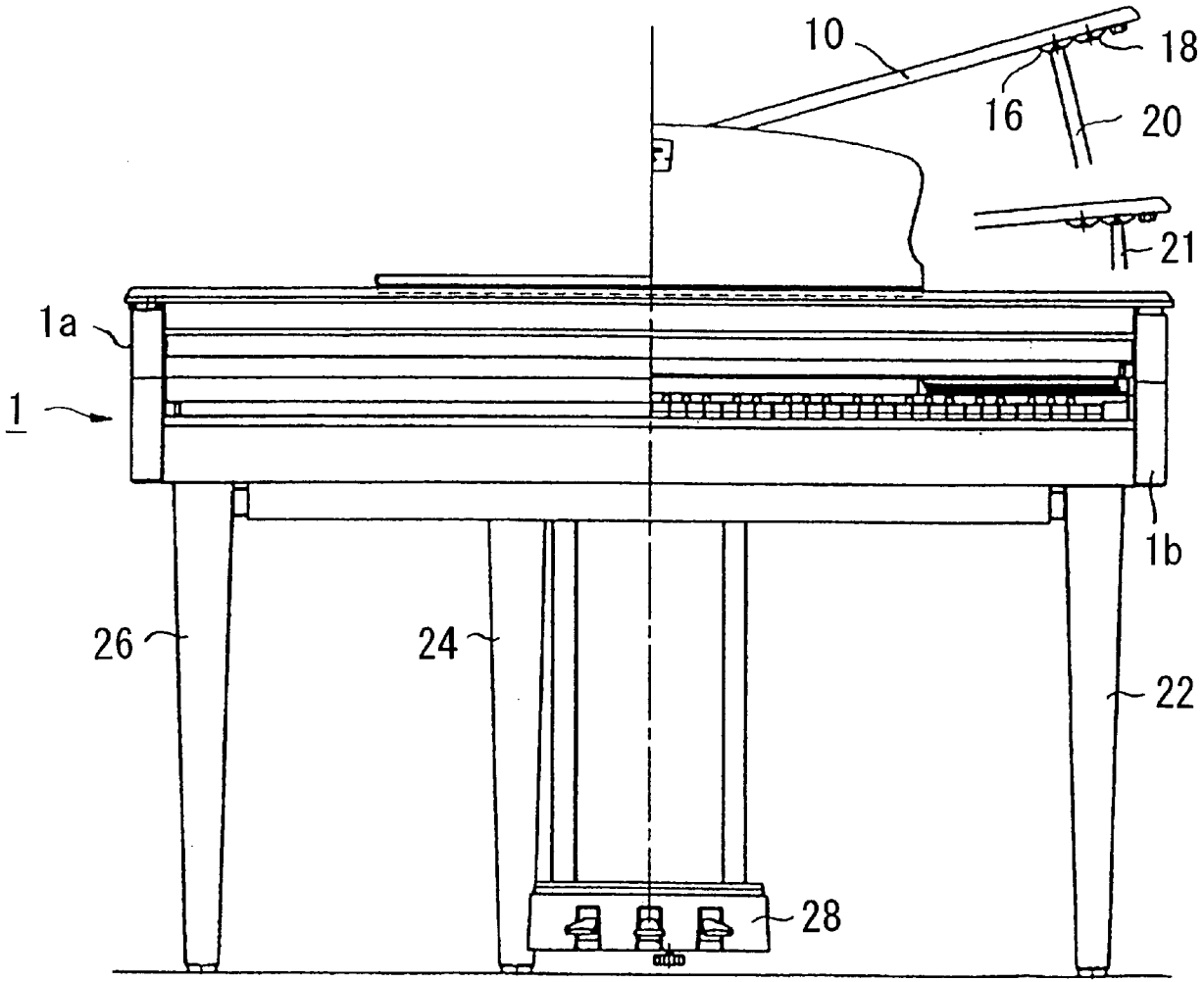
FIG. 2 is a front view of the electronic piano.
Figure 3:
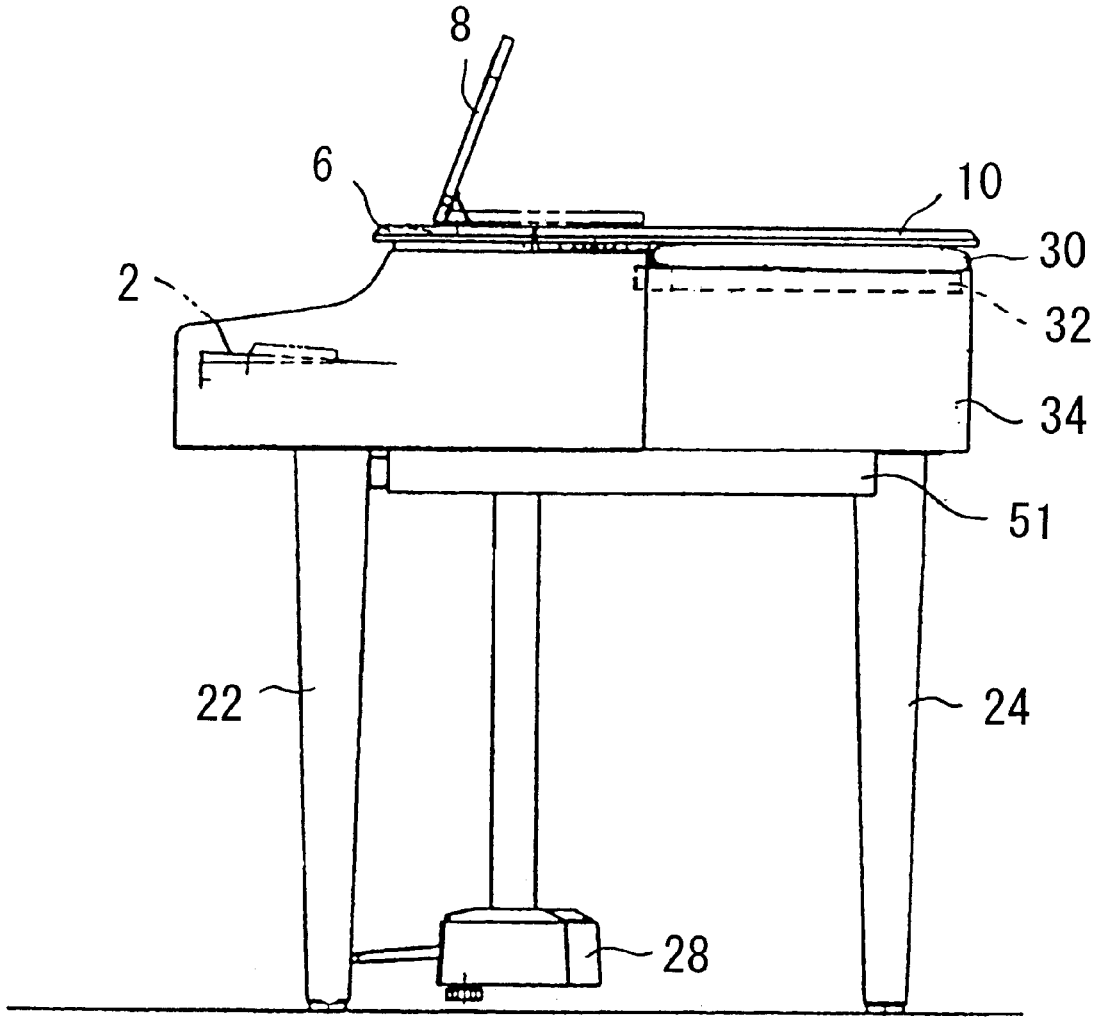
FIG. 3 is a side view showing the right side of the electronic piano.

In FIG. 2, reference numerals 20 and 21 designate a long stay and a short stay respectively. By engaging the ends of the stays 20, 21 with the stay receptors 16, 18, the right hand of the reflector board 10 is lifted up in a slanted manner and is stopped at different angles of inclination with respect to the hinge 12. That is, the right hand of the reflector board 10 is lifted up and is stopped at a relatively large angle of inclination by engaging the end of the long stay 20 with the stay receptor 16. In addition, the right hand of the reflector board 10 is lifted up and is stopped at a relatively small angle of inclination by engaging the end of the short stay 21 with the stay receptor 18. Reference numerals 22, 24 and 26 designate three support legs of the electronic piano respectively. Reference numeral 28 designates a pedal unit that is arranged in a lower space of the electronic piano. FIG. 3 shows a closed state of the electronic piano in which the reflector board 10 is closed. In this state, both of an upper surface of the top board 6 and an upper surface of the reflector board 10 are arranged horizontally and substantially in the same plane. Reference numeral 34 designates a side board whose shape is curved in plan view. That is, the shape of the side board 34 in plan view is designed as a nonlinear arc of continuous curves whose radiuses of circles are sequentially changed. Reference numeral 32 designates a speaker attachment plate whose side end is firmly engaged with an upper portion of the side board 34. The speaker attachment plate 34 in plan view has a prescribed curved shape that conforms with the interior wall of the side board 34. The speaker attachment plate 32 is made of a single wooden board, to which the four speakers are all fixed. In practice, the speaker attachment plate 32 is made of a relatively hard wooden board which is relatively heavy. For example, it is made of an integral structure consisting of a particle board and a veneer (or fine wood). A speaker net 30 is provided in the space between the speaker attachment plate 32 and the reflector board 10. The main body 1 of the electronic piano is supported by a bone structure 51 that is made of a metal material.

Figure 4:
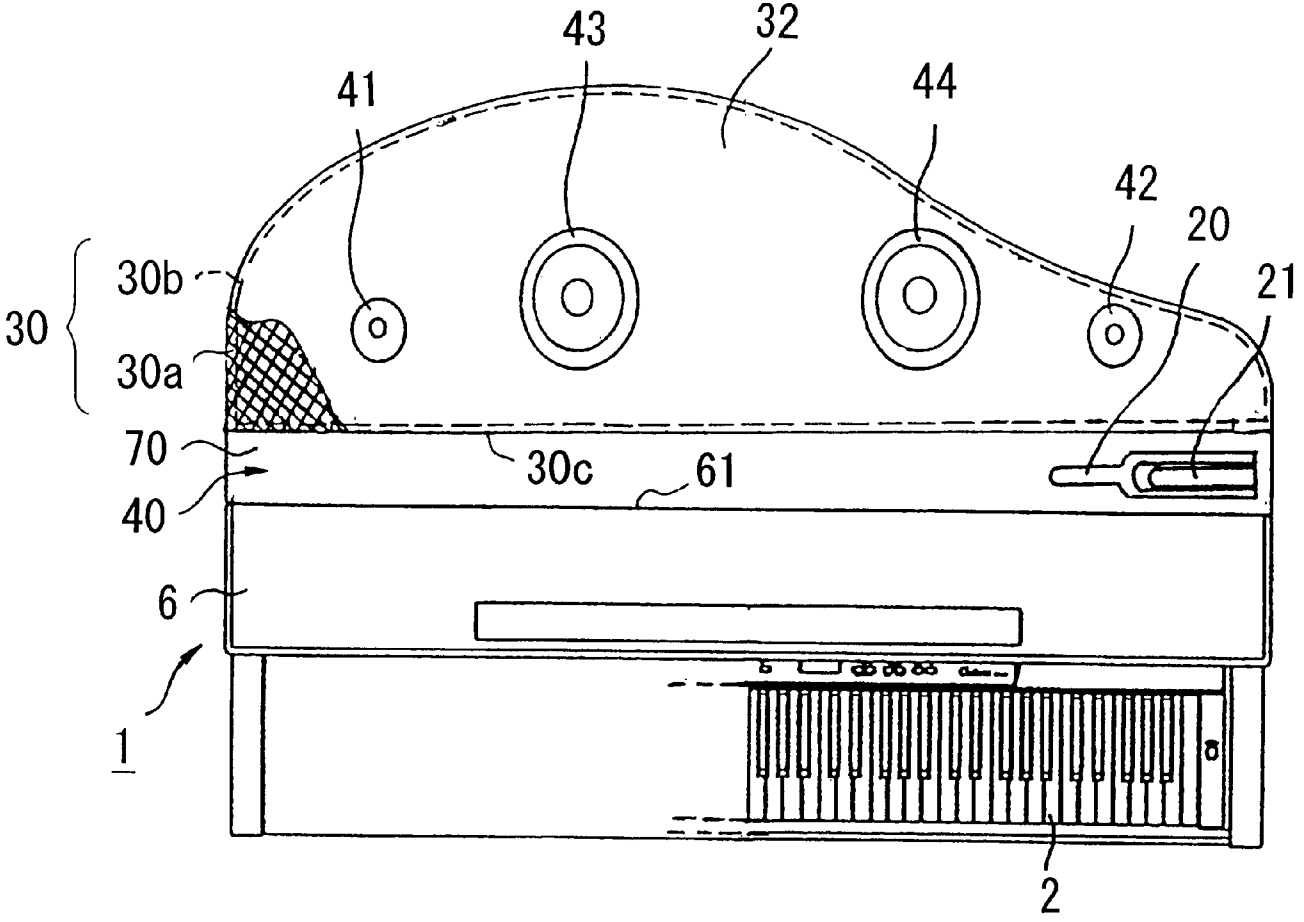
FIG. 4 is a plan view showing the internal parts of the electronic piano from which the reflector board and the music stand have been removed, as compared with the plan view of FIG. 1.

FIG. 4 shows a stripped state of the electronic piano in plan view, from which the reflector board 10 and the music stand 8 have been removed, as compared with the plan view of FIG. 1. In FIG. 4, the speaker net 30 is configured by a net 30*a* and a bone member 30*b* made of a metal material. The net 30*a* entirely covers the upper surface of the bone member 30*b*. The speaker net 30 is detachably attached to the speaker attachment plate 32 by using 'magic tapes' (registered trade mark in Japan). For the sake of convenience, FIG. 4 shows a part of the speaker net 30 provided inside of the casing of the electronic piano. Specifically, the speaker net 30 is arranged in a space defined by the side board 34 within the casing of the electronic piano, and it is formed to entirely cover the upper surface of the speaker attachment plate 32. The top board 6 is arranged to be separated from the speaker net 30 in its front direction by a prescribed space. The width of the top board 6 is shortened to provide such a prescribed space between the top board 6 and speaker net 30 towards the rear of the casing of the electronic piano. That is, the prescribed space, which is a rectangular recess portion 40, is formed between a front end 30*c* of the speaker net 30 and a back end 61 of the top board 6 and above a shelf board 70.

Because of the aforementioned configuration, the user of the electronic piano is able to store the aforementioned stays 21, 22 as well as small articles such as cloths for maintenance and writing materials in the rectangular recess portion 40. By closing the reflector board 10, it is possible to hide them inside of the casing of the electronic piano. The present embodiment is characterized in that the reflector board 10 is made wider than the total area of the speaker attachment plate 32. This allows reflection of sounds from a wide range of the area of the electronic piano. Particularly, in a concert where the player plays the electronic piano with the reflector board 10 to open, it is possible to make the musical tones clearly. As a result, the player and the audience can easily hear the musical tones produced by the electronic piano. Reference numerals 41 to 44 designate speakers, which are arranged inside of the casing and are attached to the speaker attachment plate 32. Specifically, reference numerals 41 and 42 designate left and right tweeters, and reference numerals 43 and 44 designate left and right woofers.

Figure 5:
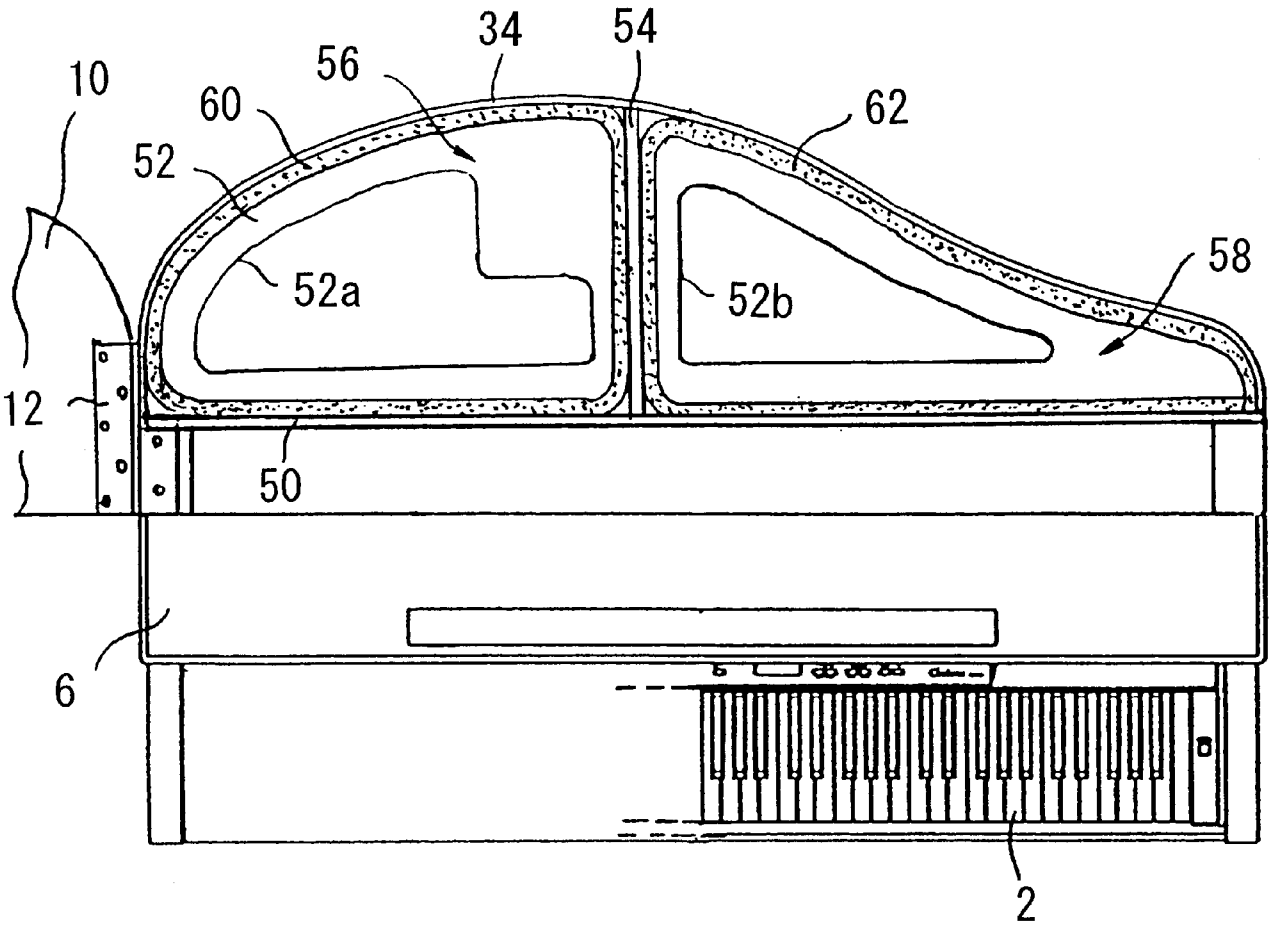
FIG. 5 is a plan view showing the internal parts of the electronic piano from which a speaker net and a speaker attachment plate are further removed as compared with the plan view of FIG. 4.

FIG. 5 shows a further stripped state of the electronic piano in plan view, from which the speaker net 30 and speaker attachment plate 32 have been removed, as compared with the plan view of FIG. 4. Herein, reference numeral 50 designates an enclosure partition plate, which is made of a rectangular board of wood material. The enclosure partition plate 50 has substantially the same height as the side board 34, and it is fixed to the bone structure 51 shown in FIG. 3. Reference numeral 54 designates an enclosure separation plate, which has substantially the same height as the side board 34 and the enclosure partition plate 50. The enclosure separation plate 54 is located slightly to the left of the center of the casing of the electronic piano, and it is arranged between the side plate 34 and the enclosure partition plate 50 to extend in a rearward direction of the casing of the electronic piano. The ends of the enclosure separation plate 54 are firmly attached to the side board 34 and the enclosure partition plate 50 respectively.

Reference numeral 52 designates a bottom plate made of a wood material. In the casing of the electronic piano, a flattened cylindrical space is formed and defined by the side board 34 and enclosure partition plate 50. The bottom plate 52 has a prescribed shape that conforms with the bottom shape of the flattened cylindrical space. Circumferential portions of the bottom plate 52 are firmly attached to the lower ends of the side board 34 and enclosure partition plate 50. The flattened cylindrical space encompassed by the side board 34, enclosure partition plate 50 and bottom plate 52 is divided into two sections by the enclosure separation plate 54, namely a left enclosure 56 and a right enclosure 58. Using the enclosure separation plate 54, it is possible to reinforce the casing of the electronic piano. Relatively large through holes 52*a* and 52*b* are formed to penetrate through the bottom plate 52 in connection with the left enclosure 56 and right enclosure 58 respectively. Herein, the through hole 52*a* is enlarged in area substantially in conformity with the bottom shape of the left enclosure 56 with small tolerances from its inner periphery. Similarly, the through hole 52*b* is enlarged in area substantially in conformity with the bottom shape of the right enclosure 58 with small tolerances from its inner periphery. The total opening area of the through holes 52*a* is made larger than the total area of the speakers 41 to 44. A muffler 60 is arranged along and firmly attached to the interior walls of the left enclosure 56 all around, while a muffler 62 is arranged along and firmly attached to the interior walls of the right enclosure 58 all around. The mufflers 60, 62 have a prescribed thickness, which approximately ranges between 5 mm and 20 mm.

One of the outstanding features of the present embodiment is to use the relatively 'thin' mufflers 60, 62 inside of the casing of the electronic piano. Sounds produced by the speakers 41 to 44 are radiated from their backsides and propagate through the through holes 52*a* and 52*b,* from which they are transmitted to and reflected by the floor surface. Reflected sounds are transmitted towards the audience through the air. In addition, the casing of the electronic piano as a whole vibrates in response to vibrations caused by the speakers 41 to 44, so that the electronic piano produces additional sounds caused by the vibrations. The design of the present embodiment attaches great importance to these additional sounds due to the vibrations. That is, the electronic piano of the present embodiment is characterized by using the thin mufflers 60 and 62 to provide for the generation of the additional sounds. When the player plays the keyboard 2 of the electronic piano with the reflector board 10 to open at a certain angle of inclination, the electronic piano produces musical tones from the speakers 41 to 44. Herein, the musical tones radiated from the upper surfaces of the speakers 41–44 are reflected by the reflector board 10. In addition, the musical tones radiated from the lower surfaces of the speakers 41–44 are reflected by the floor. Further, the casing of the electronic piano as a whole vibrates in response to vibrations of the speakers 41–44, which are transmitted thereto by way of the speaker attachment plate 32 and the thin mufflers 60, 62. Therefore, the electronic piano can output mixed sounds of the reflected musical tones and additional sounds caused by vibrations of the speakers 41–44. Similarly to an acoustic piano, the mixed sounds of the electronic piano of the present embodiment are transmitted towards the audience through the air.

Figure 6:
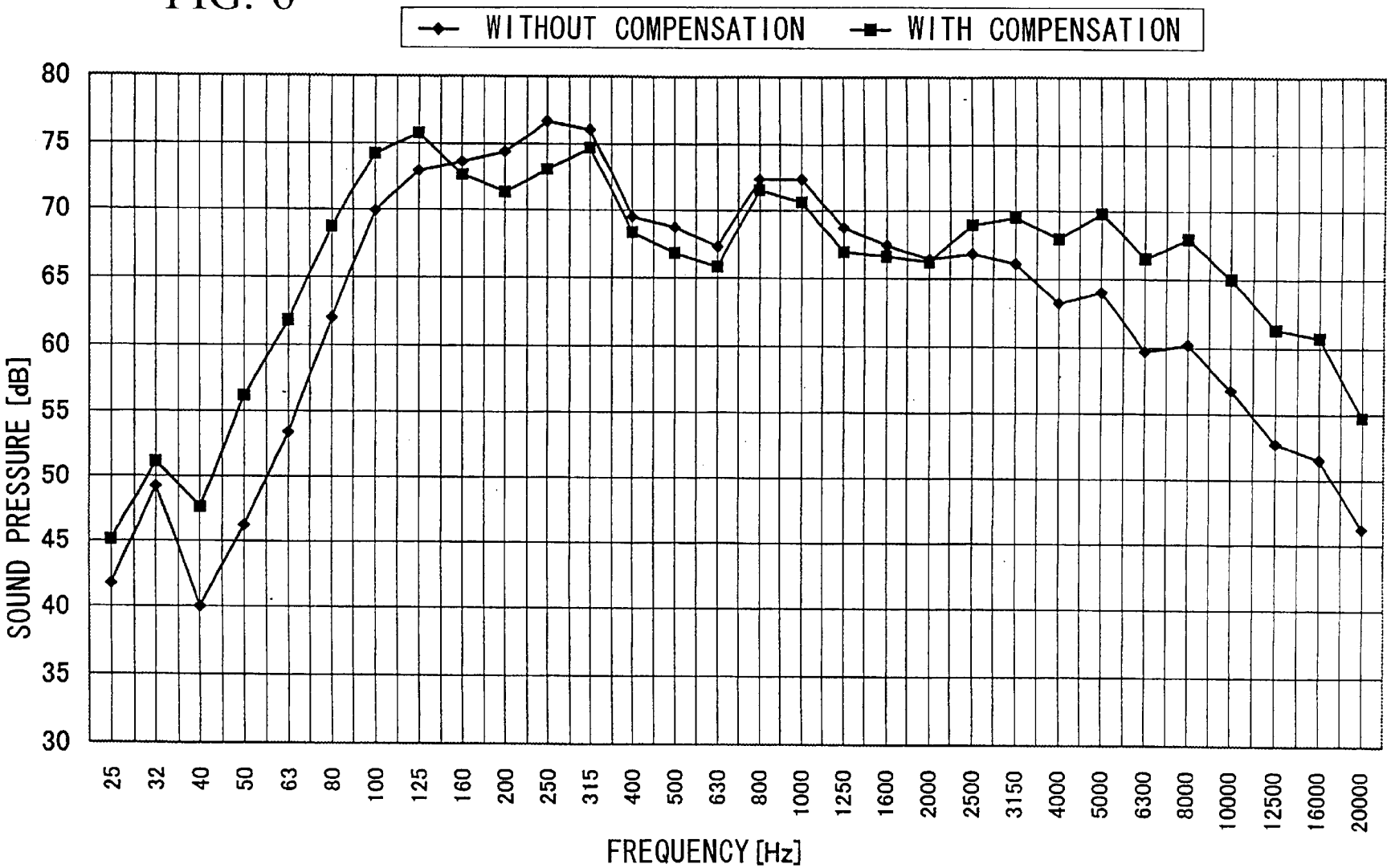
FIG. 6 is a graph showing the frequency characteristics of the sounds produced by the electronic piano.

FIG. 6 shows the frequency characteristics of the sounds produced by the electronic piano in accordance with the present embodiment. The graph of FIG. 6 is made by actually measuring the frequency characteristics at prescribed locations, which correspond to the usual location of the ears of the player in a normal position. Specifically, FIG. 6 shows two types of curves, which represent the frequency characteristics with and without compensation. That is, the first curve (i.e., a line chart connecting diamond-shaped symbols, denoted by "without compensation") represents variations of the sound pressure that are measured by applying flat outputs to the speakers 41–44 via an amplifier while sweeping the frequency. The second curve (i.e., a line chart connecting square-shaped symbols, denoted by "with compensation") represents variations of the sound pressure that are measured while using equalizers connected before and after the amplifier of the speakers 41–44. As shown in FIG. 6, the equalizers are set so that the sound pressure is increased by approximately 0 –10 dB in a low-frequency range under 160 Hz, the sound pressure is decreased by approximately 0 –4 dB in an intermediate frequency range between 160 Hz and 2 kHz, and the sound pressure is increased by approximately 0 –10 dB in a high-frequency range above 2 kHz.

As compared with the general speaker boxes, the enclosures of the electronic piano of the present embodiment have low closing degrees. So, even if the mufflers 60, 62 have small thickness, it is possible to obtain substantially 'flat' frequency characteristics. This is because the enclosures are defined by the side board 34 that has a nonlinear arc shape in plan view. In other words, it can be presumed that undesirable influences due to circumfluence and standing waves at specific frequencies are weakened by the aforementioned shape of the side board 34 defining the enclosures 60, 62.

As described heretofore, this invention provides the electronic piano with a musical tone generation structure that resembles the mechanical structure of an acoustic piano. Thus, it is possible to accurately reproduce the musical tones of acoustic pianos along with their nuance of musical expression.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to be embraced by the claims.

What is claimed is:

1. A musical tone generation structure of an electronic musical instrument comprising:

a speaker attachment plate that is arranged substantially horizontal within a casing of the electronic musical instrument in its normal use state;

a plurality of speakers attached to the speaker attachment plate such that front sides thereof are directed upwards; and an enclosure portion that are formed in connection with backsides of the speakers attached to the speaker attachment plate within the casing of the electronic musical instrument, wherein the enclosure portion has a sound release hole whose opening is directed downwards from a bottom thereof, wherein a total area of the opening of the sound release hole is larger than a total area of the speakers.

2. The musical tone generation structure of an electronic musical instrument according to claim 1 wherein the enclosure portion has a nonlinear arc shape in plan view.

3. A musical tone generation structure of an electronic musical instrument comprising:

at least two speakers; and an enclosure portion that is defined by an upper plate, a side board and a bottom plate within a casing of the electronic musical instrument, wherein the upper plate to which the speakers are att ached such that their front sides are directed upwards is arranged substantially horizontal in a normal use state of the electronic musical instrument, the side board is arranged to define an exterior contour of the casing and is connected with the upper plate and the bottom plate respectively, and the bottom plate is arranged in connection with backsides of the speakers attached to the upper plate, wherein a plurality of sound release holes whose openings are directed downwards are formed to penetrate through the bottom plate of the enclosure portion such that a total area of the openings of the sound release holes is larger than a total area of the speakers, and wherein a separation plate is provided to divide an entire space of the enclosure portion into plural sections in connection with the sound release holes respectively.

4. The musical tone generation structure of an electronic musical instrument according to claim 3 further comprising a reflector board whose one side is closed or opened at a prescribed angle of inclination with respect to a horizontal plane corresponding to a top board of the electronic musical instrument, wherein the reflector board is arranged above the speakers attached to the front plate of the enclosure portion.

5. The musical tone generation structure of an electronic musical instrument according to claim 4 wherein a left end of the reflector board functions as an axis so that a right side of the reflector board rotates about the axis and is opened in a viewpoint of a player who plays the electronic musical instrument, and wherein the reflector board, when closed, is placed in proximity to the top board and is arranged substantially in parallel to or within the same plane as the top board.

6. The musical tone generation structure of an electronic musical instrument according to claim 5 further comprising a hinge that connects an upper left end of the casing and the left end of the reflector board so that the right side of the reflector board is hinged to open or close in a viewpoint of the player who plays the electronic musical instrument.

7. The musical tone generation structure of an electronic musical instrument according to claim 4 further comprising a holding member for changing and holding the angle of inclination of the reflector board.

8. A musical tone generation structure of an electronic musical instrument comprising:

a speaker attachment plate;

a plurality of speakers attached to the speaker attachment plate such that front sides thereof are directed upwards; and an enclosure portion that is arranged in connection with backsides of the speakers within a casing of the electronic musical instrument, wherein a sound release hole is formed to penetrate through a bottom of the enclosure portion, and a total area of an opening of the sound release hole is larger than a total area of the speakers.

9. An electronic musical instrument comprising:

a speaker attachment plate that is arranged substantially horizontal within a casing in a normal use state;

a plurality of speakers attached to the speaker attachment plate such that front sides thereof are directed upwards; and an enclosure portion that are formed in connection with backsides of the speakers attached to the speaker attachment plate within the casing, wherein the enclosure portion has a sound release hole whose opening is directed downwards from a bottom thereof, and wherein a total area of the opening of the sound release hole is larger than a total area of the speakers.

10. An electronic musical instrument comprising:

at least two speakers; and an enclosure portion that is defined by an upper plate, a side board and a bottom plate within a casing, wherein the upper plate to which the speakers are attached such that their front sides are directed upwards is arranged substantially horizontal in a normal use state, the side board is arranged to define an exterior contour of the casing and is connected with the upper plate and the bottom plate respectively, and the bottom plate is arranged in connection with backsides of the speakers attached to the upper plate, wherein a plurality of sound release holes whose openings are directed downwards are formed to penetrate through the bottom plate of the enclosure portion such that a total area of the openings of the sound release holes is larger than a total area of the speakers, and wherein a separation plate is provided to divide an entire space of the enclosure portion into plural sections in connection with the sound release holes respectively.

11. An electronic musical instrument comprising:

a speaker attachment plate;

a plurality of speakers attached to the speaker attachment plate such that front sides thereof are directed upwards; and an enclosure portion that is arranged in connection with backsides of the speakers within a casing, wherein a sound release hole is formed to penetrate through a bottom of the enclosure portion, and a total area of an opening of the sound release hole is larger than a total area of the speakers.

12. An electronic piano comprising:

a keyboard;

a top board;

a reflector board that is normally arranged to the rear of a casing and is arranged substantially in the same plane of the top board, wherein the reflector board is hinged to close or open with a prescribed angle of inclination to the top board;

a speaker attachment plate that is placed substantially horizontal within a casing;

a plurality of speakers attached to the speaker attachment plate such that front sides thereof are directed upwards; and an enclosure portion that is formed inside of the casing below the speaker attachment plate and is accompanied with a muffler having a relatively small thickness, wherein a sound release hole whose opening is directed downwards is formed to penetrate through a bottom of the enclosure portion, and wherein a total area of the opening of the sound release hole is larger than a total area of the speakers.

13. An electronic piano according to claim 12 wherein the enclosure portion is defined by a side board that has a nonlinear arc shape in plan view.

14. An electronic piano according to claim 12 further comprising a stay for supporting a right side of the reflector board so as to be inclined at a prescribed angle with respect to the top board.

* * * * *